United States Patent [19]

Nishikawa et al.

[11] Patent Number: 4,869,973

[45] Date of Patent: Sep. 26, 1989

[54] THIN FILM ELECTROLUMINESCENCE DISPLAY DEVICE

[75] Inventors: Masahiro Nishikawa, Amagasaki; Takao Tohda, Ikoma; Jun Kuwata, Katano; Yosuke Fujita, Kobe; Tomizo Matsuoka, Neyagawa; Atsushi Abe, Ikoma, all of Japan

[73] Assignee: Matsushita Electric Industrial Co., Ltd., Kadoma, Japan

[21] Appl. No.: 93,263

[22] Filed: Sep. 4, 1987

[30] Foreign Application Priority Data

Sep. 5, 1986 [JP] Japan ..... 61-209898
Apr. 10, 1987 [JP] Japan ..... 62-89406

[51] Int. Cl.[4] ..... H05B 33/00; H05B 33/10; H05B 33/14

[52] U.S. Cl. ..... 428/690; 428/917; 313/503; 313/509

[58] Field of Search ..... 428/690, 691, 917; 313/506, 503, 509

[56] References Cited

U.S. PATENT DOCUMENTS 3,854,070 12/1974 Vlasenko et al. ..... 313/503
4,365,184 12/1982 Higton et al. ..... 313/503
4,442,377 4/1984 Higton et al. ..... 313/503
4,717,858 1/1988 Tanaka et al. ..... 313/503
4,720,436 1/1988 Ohseto et al. ..... 428/690
4,727,004 2/1988 Tanaka et al. ..... 428/690

FOREIGN PATENT DOCUMENTS 0209668 1/1987 European Pat. Off. ..... 313/506

*Primary Examiner*—Nancy A. B. Swisher
*Attorney, Agent, or Firm*—Cushman, Darby & Cushman

[57] ABSTRACT

In a thin film EL display device wherein a transparent electrode, a first dielectric layer, an EL emission layer, a second dielectric layer and a back electrode are laminated in order on a transluscent substrate, a 10 nm–200 nm thickness of thin film made of calcium sulfide or a mixture containing calcium sulfide which is formed by an electron beam vapor deposition method provided between the first dielectric layer and the EL emission layer and between the EL emission layer and the second dielectric layer, thereby obtaining a thin film EL display device which maintains a stable operation for a long period even when it is driven by A.C. pulses which are a symmetric with respect to the time relationship of the driving pulses (e.g., the time period between the start of a positive pulse and the start of the subsequent negative pulse is different than the time period between the start of a negative pulse and the start of the subsequent positive pulse) or are different in amplitude in a positive side and a negative side.

9 Claims, 4 Drawing Sheets

THIN FILM ELECTROLUMINESCENCE DISPLAY DEVICE

FIELD OF THE INVENTION AND RELATED ART STATEMENT

1. Field of the Invention

The present invention relates to an electroluminescence cell (hereinafter referred to as EL display device), and more particularly to a thin film EL display device to be driven by an alternating current. This light emitting device has a flat panel display and is suitable for displaying characters and graphics on the terminal of a personal computer or the like, and is widely used in office equipment.

2. Description of the Related Art

Heretofore, an X-Y matrix display has been known as a flat panel display using an electroluminescence phosphor. In the X-Y matrix display, horizontal parallel electrode groups and vertical parallel electrode groups are arranged on both sides of an electroluminescence light emission layer (hereinafter referred to as EL emission layer), in a manner to intersect at each other with right angles in plan view. An electric signal is applied across these electrode groups from a feeder through switches, thereby emitting light at the parts where the horizontal electrode groups and vertical electrode groups intersect each other (hereinafter each small element of the EL emission layer at an electrode intersection which is driven to emit light is referred to as a pixel.), and then by combining the light-emitting pixel, letters, symbols, figures or the like are displayed.

A type panel of this display is generally made as follows: first, transparent front side parallel electrode groups are provided on a transluscent substrate such as a glass plate, and then a first dielectric layer, the EL emission layer and a second dielectric layer are laminated thereon one after another, and further, back side parallel electrode groups are provided thereon in a manner to intersect the underlying transparent parallel electrode groups at right angles. The transparent parallel electrode is generally formed by applying tin oxide on a smooth glass substrate. The back electrode is generally formed by vacuum deposition of aluminum or the like.

Materials having a large dielectric constant and a large dielectric breakdown electric field are suitable for the first and the second dielectric layers, which are to be driven by low voltage. Having a large dielectric constant is necessary for efficiently applying a high level of voltage, which is applied from the transparent electrode and the back electrode, to the EL emission layer, thereby reducing the necessary driving voltage. A large dielectric breakdown electric field is required for safe operation without causing dielectric breakdown. For such a dielectric layer, constituting a thin film electroluminescence cell (hereinafter referred to as thin film EL display device) with good stability, oxide dielectric films with large dielectric constants are more suitable than silicon oxide or silicon nitride, which have small dielectric constants. Therefore, the thin film EL display device using the oxide dielectric film is being researched widely.

When the thin film EL display device having a matrix electrode is driven with an addressing method that sequentially scans the rows from the top to the bottom of the device after each row of the device, has been scanned, a refresh pulse is applied to the rows, thereby doubling light emissions in one scanning period. In each pixel between the transparent electrodes and the back electrodes, the period from start of the positive pulse to start of the negative pulse is not equal to the period from start of application of negative pulse to start of application of positive pulse. That is the, driving pulses have an asymmetrical time relationship. When the conventional thin film EL display device is driven for a long time under such conditions a problem develops which is that in the pixels driven to emit light, the light emission threshold voltage changes by several volts in comparison to the change in voltage of the picture elements which have not been lit.

OBJECT AND SUMMARY OF THE INVENTION

The present invention aims to obtain a thin film EL display device capable of stable operation for a long time even when it is driven by A.C. pulses that are asymmetric with respect to the time relationship of positive and negative pulses and/or the amplitudes of one positive and negative pulses.

The thin film EL display device comprises

- a transparent electrode provided on a transluscent substrate,
- a first dielectric layer provided on the transparent electrode,
- a first thin film made of one member selected from the group consisting of calcium sulfide and a mixture containing calcium sulfide, and provided on the first dielectric layer,
- an EL emission layer provided on the first dielectric layer,
- a second thin film made of one member selected from the group consisting of calcium sulfide and a mixture containing calcium sulfide, and provided on the EL emission layer,
- a second dielectric layer provided on the EL emission layer and
- a back electrode provided on the second dielectric layer.

Research has revealed that a decrease in threshold voltage comes from the formation of various depths of the trap level at the interface between the EL emission layer and the dielectric layers and the reaction between the EL emission layer and the dielectric layers. In the present invention, from intensive experimental research, it is confirmed that the formation of the trap level and the reaction between the EL emission layer and the dielectric layers are suppressed by providing the calcium sulfide thin film or the mixture film containing calcium sulfide between the EL emission layer and the dielectric layers by an electron beam vapor deposition method. As a result, a thin film EL display device capable of stable operation for a long time can be obtained.

DESCRIPTION OF THE PREFERRED EMBODIMENTS

Figure 1:
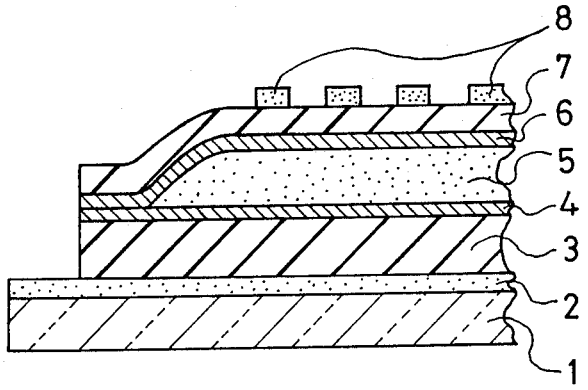
FIG. 1 is a cross sectional view showing a thin film EL display device embodying the present invention.

FIG. 1 shows a sectional construction of a thin film EL display device embodying the present invention. As a glass substrate 1, Corning #7059 glass is used. A 200 nm thick thin film of indium oxide containing tin is formed on the glass substrate 1 by a sputtering method, and is worked into a plurality of parallel strips by a photolithography, thereby forming a transparent electrode 2. Then strontium zirconium titanate $[Sr(Ti_xZr_{1-x})O_3]$ is sputtered on the transparent electrode 2 when the substrate temperature is 400° C., thereby forming an oxide dielectric layer 3 having a thickness of 600 nm as a first dielectric layer.

Furthermore, a calcium sulfide thin layer 4 having 50 nm thickness is formed on the first dielectric layer 3 by an electron beam vapor deposition method when the substrate temperature is 300° C., using a calcium sulfide pellet as a vaporization source. Onto the calcium sulfide thin layer 4, a 400 nm thick EL emission layer 5 made of zinc sulfide containing manganese is formed by an electron beam deposition method using a zinc sulfide pellet and manganese flakes as a vaporization source when the substrate temperature is 200° C.

On the EL emission layer 5, a calcium sulfide layer 6 having 50 nm thickness is formed by performing the electron beam vapor deposition when the substrate temperature is 300° C. The calcium sulfide pellets are uses as a vaporization source. After one hour of heat treatment at 500° C. in a vacuum, sintered barium tantalate $[BaTa_2O_6]$ is sputtered on the calcium sulfide layer 6 when the substrate temperature is 100° C., thereby forming a 200 nm thick oxide dielectric thin film 7 as a second dielectric layer. Moreover, a 150 nm thick aluminum layer is formed on the second dielectric layer by vacuum vapor deposition, and is worked into a plurality of parallel strips intersecting the transparent electrode 2 at a right angle, thereby forming a back electrode 8. Thus, a thin film EL display device embodying the present invention is obtained.

Figure 2:
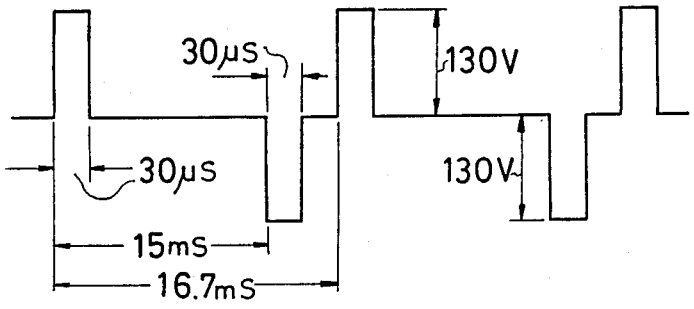
FIG. 2 is a chart of a driving voltage waveform for driving the thin film EL display device.
Figure 3:
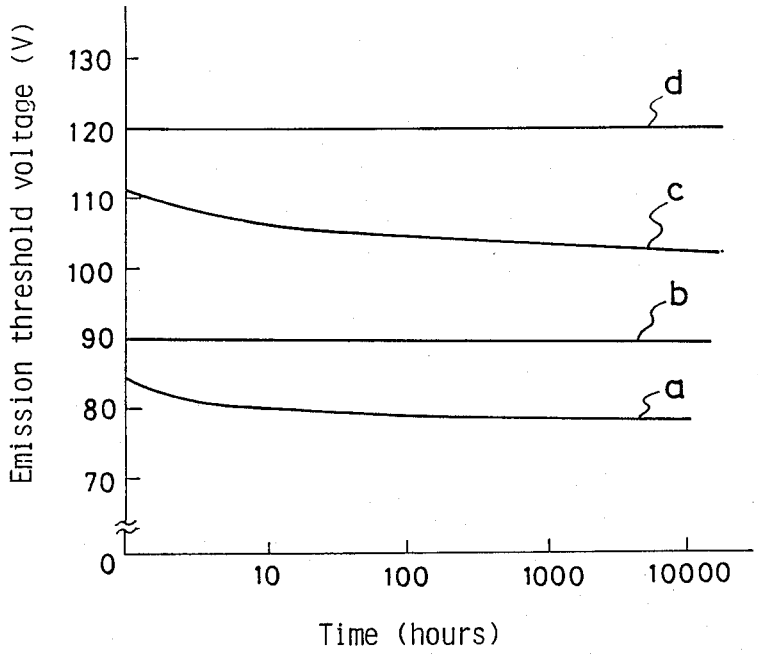
FIG. 3 is a graph showing the change in light emission threshold voltage with the passage of time.

Then, A.C. pulse voltage having an asymmetric time relationship with respect to positive and negative pulses, as shown in FIG. 2, is applied across the transparent electrode 2 and the back electrode 8 of the thin film EL display device, thereby emitting light. A change in the light emission threshold voltage (driving voltage producing a brightness of 1 $cd/m^2$) is observed. For comparison, a similar test was made with respect to the conventional thin film EL display device which did not have the calcium sulfide thin films 4 and 6. Test Results are shown in FIG. 3 with that of comparative test. As shown by curve "a" for the conventional thin film EL display device, the light emission threshold voltage decreases about 6% after 100 hours of light emission. On the other hand, as shown by curve "b" the thin film EL display device of the present invention shows a shift of the light emission threshold voltage of less than 1%.

Figure 4:
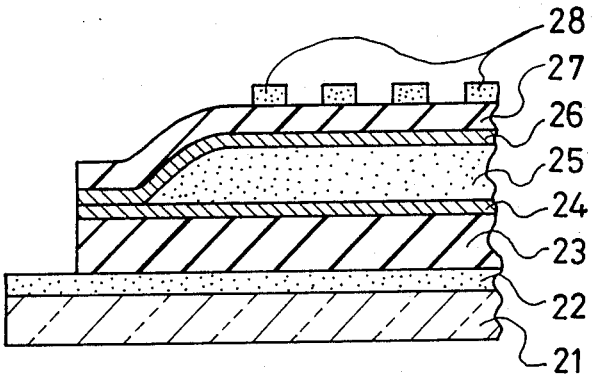
FIG. 4 is a sectional view showing a thin film EL display device of another embodiment of the present invention.

FIG. 4 shows a cross section of another embodiment of the present invention. In FIG. 4, a glass substrate 21 is made of Corning #7059 glass. A 300 nm thick thin film of indium oxide containing tin is formed on the glass substrate 21 by sputtering method, and thereafter, it is worked into a plurality of parallel strips by photolithography, thereby forming a transparent electrode 22. Then sintered barium tantalate $[BaTa_2O_6]$ is sputtered on the transparent electrode 22 when the substrate temperature is 200° C., thereby forming a 300 nm thick oxide dielectric layer 23 as the first dielectric layer. Next, a mixture thin film 24 containing calcium sulfide having 50 nm thickness is formed on the first dielectric layer 23 by the electron beam vapor deposition, using a mixture pellet of calcium sulfide and zinc sulfide as a vaporization source when the, substrate temperature is 180° C. This mixture thin film 24 contains about 10% of calcium sulfide.

On the mixture thin film containing calcium sulfide 24, a 500 nm thick thin film EL emission layer 25 made of zinc sulfide containing 1 mol % of manganese is formed by an electron beam deposition method using a zinc sulfide pellet and manganese flakes as a vaporization source and a substrate temperature of 180° C.

After one hour of heat treatment at 570° C. in a vacuum, a 60 nm thick mixture thin film containing calcium sulfide 26 is formed on the EL emission layer 25 by an electron beam vapor deposition method when the substrate temperature is 180° C., using the mixture pellet of calcium sulfide and zinc sulfide as the vaporization source. Then, sintered barium tantalate $[BaTa_2O_6]$ is sputtered on the mixture thin film 26 when the substrate temperature is 100° C., thereby forming a 200 nm thick oxide dielectric thin film 27 as a second dielectric layer. Further, a 150 nm thick aluminum layer is formed on the second dielectric layer 27 by vacuum vapor deposition, and is worked into a plurality of parallel strips intersecting the underlying transparent electrode 22 at a right angle, thereby forming a back electrode 28. Thus, another embodiment of a thin film EL display device according to the present invention is obtained.

Next, characteristics of this thin film EL display device are observed. A.C. pulse voltage which has an asymmetric time relationship with respect to positive and negative pulse as shown in FIG. 2 is applied across the transparent electrode 22 and the back side electrode 28 to cause a light emission. Then deterioration of the light emission threshold voltage is observed. For comparison, similar test was made using a thin film EL display device which does not have the mixture thin films 24 and 26 which contain calcium sulfide. Test results are is shown by curves "c" and "d" in FIG. 3. As shown by the curve "c" of FIG. 3, for the comparison thin film EL display device, the light emission threshold voltage decreases about 6% after 100 hours of light emission, while, as shown by the curve "d" for the thin film EL display device of the present invention, the decrease in the threshold voltage is only about 1 to 2%.

When a thickness of calcium sulfide thin film or mixture thin film containing calcium sulfide is under 10 nm, the effect of suppressing undesirable lowering of the light emission threshold voltage becomes small; and when the thickness thereof is above 200 nm, voltage for driving the thin film EL display device becomes too high since the dielectric constant of calcium sulfide is small. Therefore, 10–200 nm thickness is preferable.

Moreover it is preferable that the calcium sulfide thin film is formed by the electron beam vapor deposition method, because the experimental results showed that when other methods, such as a sputtering method, are used, the effect of suppressing the undesirable decrease in the light emission threshold voltage is substantially lost. Particularly, such a tendency becomes significant when the heat treatment temperature of the EL emission layer is high.

With respect to the amount of calcium sulfide contained in the mixture thin film which contains calcium sulfide, a larger amount the better. When is thin layer consists of pure calcium sulfide, it is most effective for suppressing the lowering of the light emission threshold voltage with the passage of time. However, considering an adhesive force with other layers and a manufacturing process, the thin film may contain other substances. When the amount of the other substance is more than about 5%, a practical effect can be obtained. There is no limitation with respect to the other substances to be mixed with calcium sulfide, so far as they do not ruin characteristics of the EL display device. Sulfides generally yield an excellent result, and zinc sulfide is particularly effective.

Additionally, a nitride film such as silicon nitride film, a carbide film such as silicon carbide film and a fluoride film such as magnecium fluoride film were experimentally used as substitutes for the thin film of calcium sulfide or the mixture containing the calcium sulfide. However, they were not effective for suppressing the drop of light emission threshold voltage.

As a material for the EL emission layer, zinc sulfide (ZnS) containing activator is usable. Mn, Cu, Ag, Au, $TbF_3$, $SmF_3$, $ErF_3$, $TmF_3$, $DyF_3$, $PrF_3$, $EuF_3$ or the like are suitable for the activator. Moreover, substances other than zinc sulfide which contain the activator are usable for the EL emission layer, and substances showing a electroluminescence, for example SrS and CaS containing the activator may be used.

The heat treatment of the EL emission layer is carried out to improve the light emission characteristics of the layer. The temperature of the heat treatment is preferably above 500° C., since high brightness can then be obtained. Temperature of above 650° C. is not practical, since deformation of the glass substrate is induced.

When the thickness of the oxide dielectric film used as the first dielectric layer is thicker than the second dielectric layer, stability against dielectric breakdown is high. The larger the dielectric constant of the dielectric layer is, the more preferable is the use of a thicker first dielectric layer. And as a result of the experiment, it is found that a dielectric constant above 15 is preferable. When the dielectric constant is smaller than 15, it is difficult to form the thin film EL display device which can be driven stably under a voltage of 100–180 V. For the oxide dielectric layer having a dielectric constant above 15, thin films having perovskite structure are preferable from the viewpoint of dielectric breakdown voltage. Among them, thin films made of strontium titanium binary oxide dielectrics such as $SrTiO_3$, $Sr_xMg_{1-x}TiO_3$, $SrTixZr_{1-x}O_3$, $Sr_xMg_{1-x}Ti_yZr_{1-y}O_3$ are preferable. And by using them as the first dielectric layer, a thin film EL display device showing high stability can be obtained.

Thin films made of barium tantalum binary oxide dielectrics such as $BaTa_2O_6$ are suitable for the second dielectric layer. By using them, it becomes possible to suppress a propagation dielectric breakdown, and as a result, a thin film EL display device having high reliability is obtained. The thin films made of barium tantalum binary oxide dielectrics also have excellent characteristics when they are used as the first dielectric layer, and therefore it is possible to form a stable thin film EL display device showing high dielectric breakdown voltage by using them as the first dielectric layer.

Although the invention has been described in its preferred form with a certain degree of particularity, it is understood that the present disclosure of the preferred form can be changed in the details of construction and the combination and arrangement of parts may be altered without departing from the spirit and the scope of the invention as hereinafter claimed.

What is claimed is:

1. A thin film EL display device comprising a transparent electrode provided on a transluscent substrate, a first dielectric layer provided on said transparent electrode, a first thin film made of one member selected from the group consisting of calcium sulfide and a mixture containing calcium sulfide and provided on said first dielectric layer, an EL emission layer provided on said first dielectric layer, a second thin film made of one member selected from the group consisting of calcium sulfide and a mixture containing calcium sulfide and provided on said EL emission layer, a second dielectric layer provided on said EL emission layer and a back electrode provided on said second dielectric layer.

2. A thin film EL display device in accordance with claim 1 wherein;

said first dielectric layer is made of an oxide dielectric film having a dielectric constant of more than 15.

3. A thin film EL display device in accordance with claim 1 wherein;

said second dielectric layer is made of an oxide dielectric film.

4. A thin film EL display device in accordance with claim 1 wherein;

said first and second thin films are made of a mixture of calcium sulfide and zinc sulfide.

5. A thin film EL display device in accordance with claim 1 wherein;

said first dielectric layer is made of an oxide dielectric having perovskite structure.

6. A thin film EL display device in accordance with claim 1 wherein;

said first dielectric layer is made of strontium titanium binary oxide dielectrics.

7. A thin film EL display device in accordance with claim 1 wherein;

said second dielectric layer is made of barium tantalum binary oxide dielectrics.

8. A thin film EL display device in accordance with claim 1 wherein;

said EL emission layer is made of zinc sulfide activated by manganese.

9. A thin film EL display device comprising a transparent electrode provided on a translucent substrate, a first dielectric layer provided on said transparent electrode, a first thin film having a 10 nm–200 nm thickness comprised of one member selected from the group consisting of calcium sulfide and a mixture containing calcium sulfide and formed on said first dielectric layer by an electron beam vapor deposition method, an EL emission layer provided on said first dielectric layer, a second thin film made having a 10 nm–200 nm thickness of one member selected from the group consisting of calcium sulfide and a mixture containing calcium sulfide and formed on said EL emission layer by an electron beam vapor deposition method, a second dielectric layer provided on said EL emission layer, a back electrode provided on said second dielectric layer.

* * * * *